US009773454B2

(12) United States Patent
Kim

(10) Patent No.: US 9,773,454 B2
(45) **Date of Patent: *Sep. 26, 2017**

(54) ORGANIC LIGHT EMITTING DISPLAY DEVICE AND DRIVING METHOD THEREOF

(71) Applicant: SAMSUNG DISPLAY CO., LTD., Yongin, Gyeonggi-Do (KR)

(72) Inventor: Yang-Wan Kim, Yongin (KR)

(73) Assignee: Samsung Display Co., Ltd., Yongin, Gyunggi-do (KR)

( * ) Notice: Subject to any disclaimer, the term of this patent is extended or adjusted under 35 U.S.C. 154(b) by 202 days.

This patent is subject to a terminal disclaimer.

(21) Appl. No.: 14/449,530

(22) Filed: Aug. 1, 2014

(65) Prior Publication Data

US 2015/0061983 A1 Mar. 5, 2015

(30) Foreign Application Priority Data

Aug. 29, 2013 (KR) ..... 10-2013-0103039

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2300/0819* (2013.01); *G09G 2300/0842* (2013.01); *G09G 2300/0861* (2013.01); *G09G 2310/0262* (2013.01); *G09G 2310/0297* (2013.01); *G09G 2320/043* (2013.01)

(58) Field of Classification Search
CPC ..... G09G 3/3233; G09G 3/3275; G09G 2300/0819; G09G 2300/0842; G09G 2300/0861; G09G 2310/0262; G09G 2310/0297; G09G 2320/043
See application file for complete search history.

(56) References Cited

U.S. PATENT DOCUMENTS 8,816,998 B2 * 8/2014 Pyon ..... G09G 3/3225 345/204
2006/0267885 A1 * 11/2006 Kwak ..... G09G 3/3233 345/76
2007/0040764 A1 * 2/2007 Kim ..... G09G 3/3291 345/30
2007/0057877 A1 * 3/2007 Choi ..... G09G 3/3233 345/76
2011/0164015 A1 * 7/2011 Kim ..... G09G 3/3275 345/211
2012/0001950 A1 1/2012 Kim
(Continued)

FOREIGN PATENT DOCUMENTS

KR 10-2008-0014331 A 2/2008
KR 10-2011-0133812 A 12/2011
KR 10-2012-0002069 A 1/2012

*Primary Examiner* — Nelson Rosario
(74) *Attorney, Agent, or Firm* — Lee & Morse, P.C.

(57) ABSTRACT

An organic light emitting display device includes a plurality of pixels, a data driver, and a plurality of demultiplexers. The pixels are in an area defined by scan lines and data lines. The data driver progressively supplies data signals to output lines every horizontal period. The demultiplexers are coupled to respective ones of the output lines. Each demultiplexer supplies data signals to a first number of data lines coupled to the demultiplexer during a horizontal period.

20 Claims, 7 Drawing Sheets

(56) References Cited

U.S. PATENT DOCUMENTS

| | | | | |
|---|---|---|---|---|
| 2014/0160172 | A1* | 6/2014 | Lee | G09G 3/3607 345/690 |
| 2015/0145843 | A1* | 5/2015 | Park | G09G 3/20 345/209 |

* cited by examiner

ORGANIC LIGHT EMITTING DISPLAY DEVICE AND DRIVING METHOD THEREOF

CROSS-REFERENCE TO RELATED APPLICATION

Korean Patent Application No. 10-2013-0103039, filed on Aug. 29, 2013, and entitled, "Organic Light Emitting Display Device and Driving Method Thereof," is incorporated by reference herein in its entirety.

BACKGROUND

1. Field

One or more embodiments described herein relate to a display device.

2. Description of the Related Art

Various types of flat panel displays have been developed. Examples include liquid crystal displays, organic light emitting displays, and plasma display panels. OLED displays generate based on a recombination of holes and electrons in an active layer. This types of displays are gaining increasing favor because of their fast response speed and low power consumption.

SUMMARY

In accordance with one embodiment, an organic light emitting display device includes a plurality of pixels in an area defined by scan lines and data lines; a data driver configured to progressively supply a plurality of data signals to output lines every horizontal period; and a plurality of demultiplexers (DEMUXs) coupled to respective ones of the output lines, each DEMUX to supply data signals to a first number of data lines coupled to the DEMUX during a horizontal period. The first number of data lines may be coupled to pixels on a same horizontal line.

Each DEMUX may be coupled two or more odd-numbered and two or more even-numbered data lines. The odd-numbered data lines may be coupled to pixels on an 1-th horizontal line, and the even-numbered data lines may be coupled to pixels on an (1+1)-th horizontal line. Adjacent odd-numbered and even-numbered data lines are alternately coupled to pixels on a same vertical line.

The odd-numbered data lines may be coupled in a zigzag form to pixels on different horizontal lines, and the even-numbered data lines may be coupled in a zigzag form to pixels on different horizontal lines. Adjacent odd-numbered and even-numbered data lines may be alternately coupled to pixels on a same vertical line.

The display device may include a scan driver configured to supply a scan signal to the scan lines; and a DEMUX controller configured to supply, to each DEMUX, control signals to overlap data signals progressively supplied from the data driver. The DEMUX controller may output the control signals, so that data signals corresponding to a (j+1)-th horizontal line are supplied when a scan signal is supplied to a scan line on a j-th horizontal line. The DEMUX controller may output the control signals, so that data signals corresponding to a first horizontal line are supplied before a scan signal is supplied to a first scan line.

One of more of the data lines coupled to a current horizontal line may be physically separated from one or more data lines coupled to an adjacent horizontal line.

In accordance with another embodiment, an organic light emitting display device includes a plurality of pixels in an area defined by scan lines and data lines; a data driver configured to progressively supply a plurality of data signals to output lines every horizontal period; a plurality of DEMUXs coupled to respective ones of the output lines; and a DEMUX controller configured to control each DEMUX to supply data signals to first data lines coupled to said each DEMUX during a first horizontal period, and to supply data signals to second data lines coupled to said each DEMUX during a second horizontal period, wherein the first data lines are respectively coupled to pixels on an 1-th horizontal line, and wherein the second data lines are respectively coupled to pixels on an (1+1)-th horizontal line.

The data signals may be supplied to the second data lines, via said each DEMUX, during a period in which a scan signal is supplied to pixels coupled to the first data lines. The first data lines may be odd-numbered data lines, and the second data lines may be even-numbered data lines. Adjacent odd-numbered and even-numbered data lines may be alternately coupled to pixels on a same vertical line.

The first data lines may include odd-numbered data lines and even-numbered data lines, and the second data lines may include odd-numbered data lines and even-numbered data lines, which are not included in the first data lines. Adjacent odd-numbered and even-numbered data lines may be alternately coupled to pixels on a same vertical line.

One of more of the data lines coupled to a current horizontal line may be physically separated from one or more data lines coupled to an adjacent horizontal line.

In accordance with another embodiment, a method of driving an organic light emitting display device includes supplying a data signal to first data lines coupled to a DEMUX during a first horizontal period; and supplying a data signal to second data lines coupled to the DEMUX during a second horizontal period, wherein the first data lines are respectively coupled to pixels on an 1-th horizontal line, and wherein the second data lines are respectively coupled to pixels on an (1+1)-th horizontal line.

The data signal may be supplied to the second data lines via the DEMUX during a period in which a scan signal is supplied to pixels coupled to the first data lines. The first data lines may be odd-numbered data lines, and the second data lines may be even-numbered data lines. The first data lines may include odd-numbered data lines and even-numbered data lines, and the second data lines may include odd-numbered data lines and even-numbered data lines, which are not included in the first data lines.

One of more of the data lines coupled to a current horizontal line may be physically separated from one or more data lines coupled to an adjacent horizontal line.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
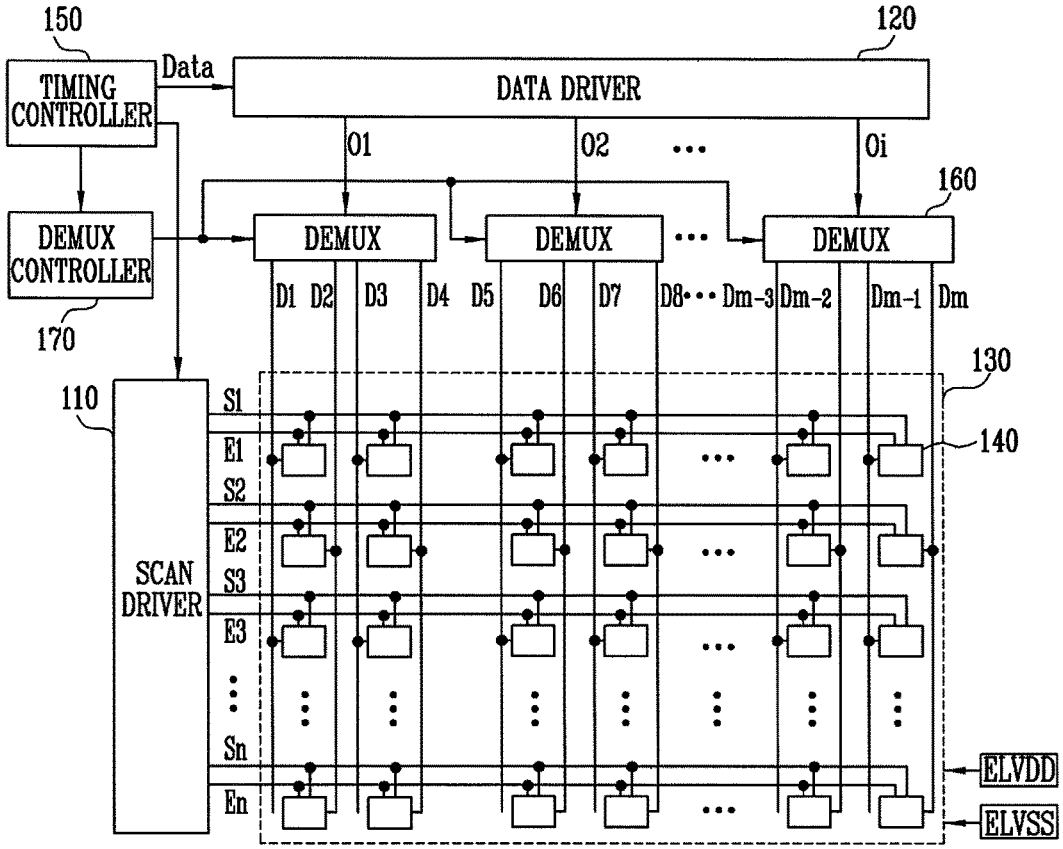
FIG. 1 illustrates an embodiment of an organic light emitting display device.

FIG. 1 illustrates an embodiment of an organic light emitting display device which includes a scan driver 110, a data driver 120, a pixel unit 130 including pixels 140, a timing controller 150, demultiplexers DEMUXs, and a DEMUX controller 170.

The pixel unit 130 includes pixels 140 in an area defined by scan lines S1 to Sn and data lines D1 to Dm. The pixels 140 receive a first power source ELVDD and a second power source ELVSS set to a voltage lower than the first power source ELVDD. The first and second power sources may be supplied from one or more external sources.

Pixels 140 receive data signals when selected in corresponding horizontal lines. The pixels are selected based on a scan signal supplied to the scan lines S1 to Sn. Each pixel 140 generates light with a luminance based on the amount of current flowing from the first power source ELVDD to the second power source ELVSS via an organic light emitting diode. This amount of current is based on the data signal.

The scan driver 110 generates a scan signal under the control of the timing controller 150, and supplies the generated scan signal to scan lines S1 to Sn. For example, the scan driver 110 may progressively supply the scan signal to scan lines S1 to Sn. The scan driver 110 generates an emission control signal under the control of the timing controller 150, and supplies the generated emission control signal to emission control lines E1 to En. For example, scan driver 110 may supply the emission control signal to a j-th emission control line Ej, which, for example, may overlap the scan signal supplied to a (j−1)-th scan line Sj−1 and a j-th scan line Sj, but this is not necessary. In other embodiments, emission control lines E1 to En may be omitted, for example, based on the circuit structure of the pixel 140.

The data driver 120 progressively supplies data signals to respective output lines O1 to Oi. In one embodiment, data driver 120 may progressively supply two data signals to each of the output lines O1 to Oi every horizontal period. The data signals to be supplied to a j-th horizontal line are supplied to overlap with the scan signal supplied to the (j−1)-th scan line Sj−1. In this case, the data signals to be supplied to the first horizontal line do not overlap the scan signal.

The DEMUXs 160 are coupled to the respective output lines O1 to Oi. Each DEMUX 160 is coupled to a plurality of data lines. For example, in a case where two data signals are supplied to each of the output lines O1 to Oi, the DEMUX 160 is coupled to four data lines. The DEMUX 160 progressively supplies the data signal to some of the data lines every horizontal period, based on a control signal from DEMUX controller 170. In other words, DEMUX 160 supplies a data signal to some of the data lines during a first horizontal period, and supplies a data signal to the other data lines during a second horizontal period. The data lines receiving data signal during the same horizontal period may be coupled to pixels 140 positioned on the same horizontal line.

Odd-numbered data line are coupled to pixels 140 on an 1-th (1 is an odd or even number) horizontal line. Even-numbered data lines are coupled to pixels 140 on an (1+1)-th horizontal line. Adjacent odd-numbered and even-numbered data lines may be alternately coupled to pixels 140 on the same horizontal line.

Each DEMUX 160 progressively supplies a data signal to odd-numbered data lines during a specific horizontal period, based on the control signal from DEMUX controller 170. Each DUMUX 16 may progressively supply a data signal to even-numbered data lines during the next horizontal period. For example, DEMUX 160 may supply a data signal to even-numbered data lines during a period in which the scan signal is supplied to an odd-numbered scan line, based on the control signal from the DEMUX controller 170. DEMUX 160 may supply a data signal to odd-numbered data lines during a period in which the scan signal is supplied to an even-numbered scan line. In this case, the data signal corresponding to the (j+1)-th horizontal line are supplied during a period in which the scan signal is supplied to the j-th scan line Sj.

The DEMUX controller 170 supplies a plurality of control signals to each DEMUX 160. In one embodiment, DEMUX controller 170 may control the supply of the control signals so that data signals are supplied for each horizontal line. For example, DEMUX controller 170 may control the supply of control signals so that odd-numbered data lines D1, D3, D5, and D7 and even-numbered data lines D2, D4, D6, and D8 are alternately coupled to output lines O1 to Oi every horizontal period.

The timing controller 150 controls the scan driver 110, data driver 120, and DEMUX controller 170 based on synchronization signals supplied from one or more external sources. The timing controller 150 realigns data DATA from an external source and supplies the realigned data DATA to data driver 120 based on control signals from DEMUX controller 170.

In FIG. 1, each DEMUX 160 is coupled to four data lines to drive pixels 140 positioned on two vertical lines. In other embodiments, each DEMUX 160 may be coupled to a different number of (e.g., six data lines) to drive pixels 140 on a plurality of (e.g., three) vertical lines. DEMUX controller 170 may be in timing controller 150.

Figure 2:
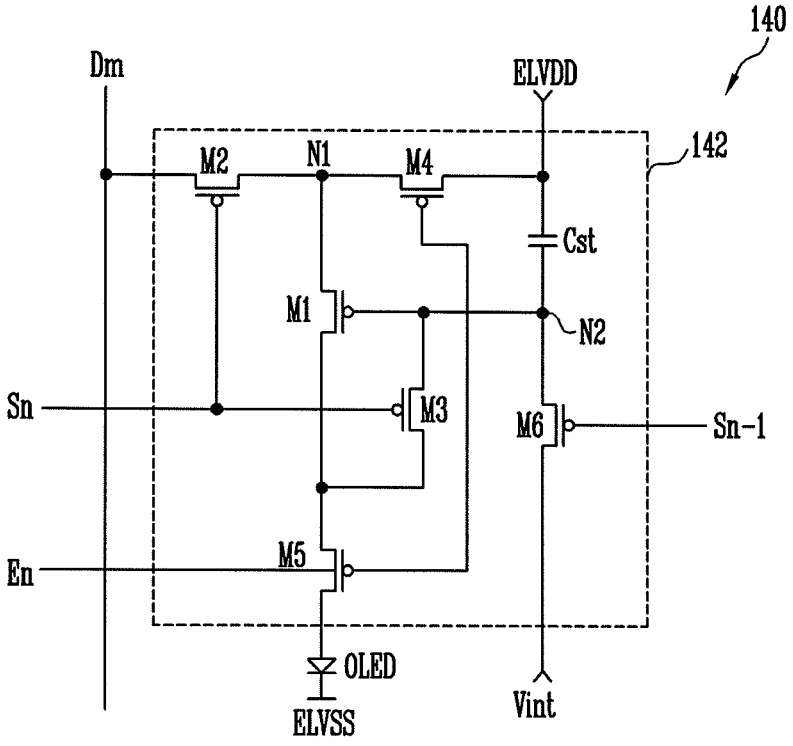
FIG. 2 illustrates an embodiment of a pixel.

FIG. 2 illustrates an embodiment of a pixel, which, for example, may be pixel 140 in FIG. 1. For illustrative purposes only, a pixel coupled to an n-th scan line Sn and an m-th data line Dm is shown in FIG. 2.

Referring to FIG. 2, pixel 140 includes an organic light emitting diode (OLED) and a pixel circuit 142 to control the amount of current supplied to the OLED. An anode electrode of the OLED is coupled to pixel circuit 142, and a cathode electrode of the OLED is coupled to second power source ELVSS. The organic light emitting diode OLED generates light with a luminance based on the amount of current supplied from pixel circuit 142.

The pixel circuit 142 stores a voltage corresponding to a data signal and the threshold voltage of a first transistor (driving transistor) M1. The pixel circuit 142 controls the amount of current supplied to the OLED based on these voltages.

In one embodiment, the pixel circuit 142 includes first to sixth transistors M1 to M6 and a storage capacitor Cst. A first electrode of the first transistor M1 is coupled to a first node N1. A second electrode of the first transistor M1 is coupled to a first electrode of the fifth transistor M5. A gate electrode of the first transistor M1 is coupled to a second node N2. The first transistor M1 controls the amount of the current supplied to the OLED based on a voltage stored in the storage capacitor Cst.

A first electrode of the second transistor M2 is coupled to a data line Dm. A second electrode of the second transistor M2 is coupled to the first node N1. A gate electrode of the second transistor M2 is coupled to an n-th scan line Sn. The second transistor M2 is turned on when a scan signal is supplied to the n-th scan line Sn, in order for a data signal to be supplied from the data line Dm to the first node N1.

A first electrode of the third transistor M3 is coupled to the second electrode of the first transistor M1. A second electrode of the third transistor M3 is coupled to the second node N2. A gate electrode of the third transistor M3 is coupled to the n-th scan line Sn. The third transistor M3 is turned on when the scan signal is supplied to the n-th scan line Sn, to place the first transistor M1 in a diode-coupled state.

A first electrode of the fourth transistor M4 is coupled to the first power source ELVDD. A second electrode of the fourth transistor M4 is coupled to the first node N1. A gate electrode of the fourth transistor M4 is coupled to an emission control line En. The fourth transistor M4 is turned off when an emission control signal is supplied to the emission control line En, and may be turned on otherwise.

The first electrode of the fifth transistor M5 is coupled to the second electrode of the first transistor M1. A second electrode of the fifth transistor M5 is coupled to the anode electrode of the OLED. A gate electrode of the fifth transistor M5 is coupled to emission control line En. The fifth transistor M5 is turned off when the emission control signal is supplied to the emission control line En, and may be turned on otherwise.

A first electrode of the sixth transistor M6 is coupled to the second node N2. A second electrode of the sixth transistor M6 is coupled to an initialization power source Vint. A gate electrode of the sixth transistor M6 is coupled to an (n−1)-th scan line Sn−1. The sixth transistor M6 is turned on when the scan signal is supplied to the (n−1)-th scan line Sn−1, in order to allow initialization power source voltage Vint to be supplied to the second node N2. The initialization power source voltage Vint may be lower than the data signal.

The storage capacitor Cst is coupled between the first power source ELVDD and the second node N2. The storage capacitor Cst stores a voltage corresponding to the data signal and the threshold voltage of the first transistor M1.

An operating process of the pixel will now be described. Initially, the emission control signal is supplied to emission control line En, so that the fourth and fifth transistors M4 and M5 are turned off. If the fourth and fifth transistors M4 and M5 are turned off, the pixel 140 is set to a non-emission state.

Subsequently, the scan signal is supplied to the (n−1)-th scan line Sn−1 in order to turn on the sixth transistor M6. If the sixth transistor M6 is turned on, the initialization power source voltage Vint is supplied to the second node N2. As a result, the second node N2 is initialized based on the initialization power source voltage Vint.

After the second node N2 is initialized, the scan signal is supplied to the n-th scan line Sn, in order to turn on the second and third transistors M2 and M3. If the third transistor M3 is turned on, the first transistor M1 is placed in a diode-coupled state. If the second transistor M2 is turned on, the data line Dm is electrically coupled to first node N1. The data signal from the data line Dm is supplied to the first node N1. When the data signal is supplied to the first node N1, the first transistor M1 is turned on. When the first transistor M1 is turned on, a voltage corresponding to the data signal and the threshold voltage of the first transistor M1 is applied to the second node N2.

Subsequently, supply of the emission control signal to the emission control line En is stopped, in order to turn on the fourth and fifth transistors M4 and M5. The first transistor M1 controls the amount of current flowing from the first power source ELVDD to the second power source ELVSS via the OLED, based on the voltage applied to the second node N2. In this case, the OLED generates light with a luminance that corresponds to the amount of supplied current.

Figure 3:
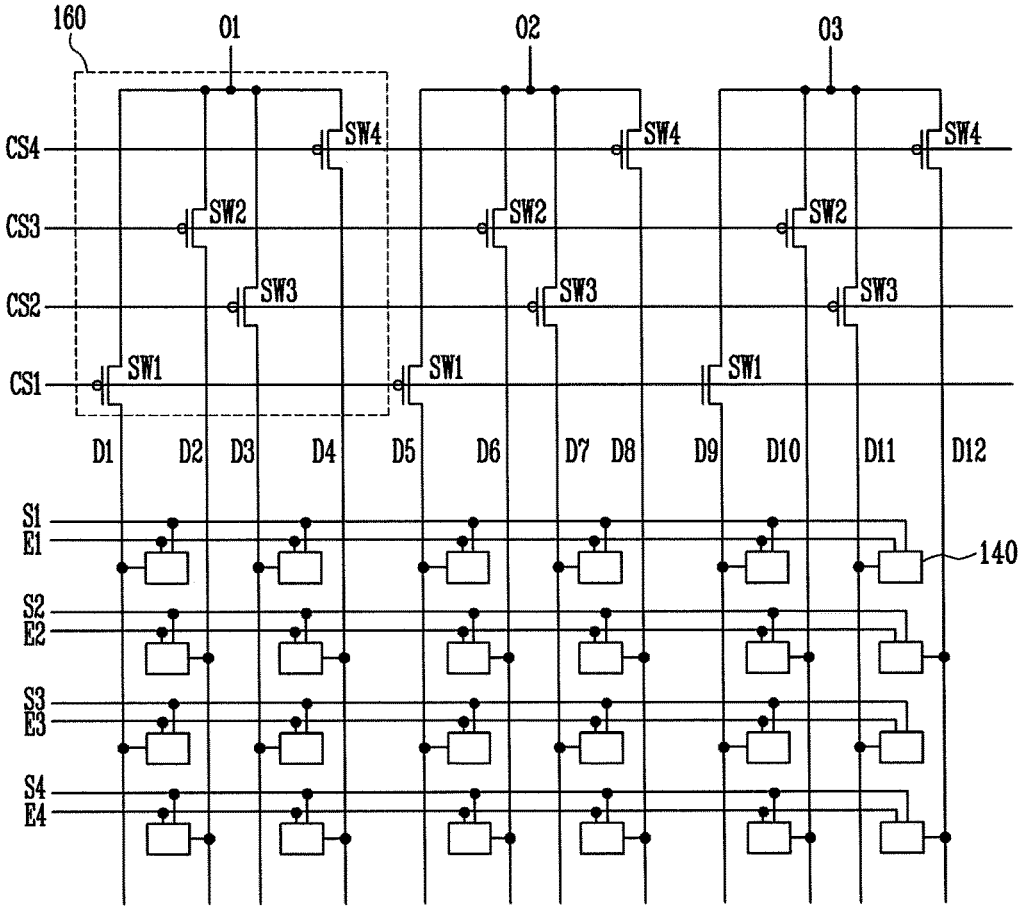
FIG. 3 illustrates an embodiment of a demultiplexer.

FIG. 3 illustrates an embodiment of DEMUX 160 in FIG. 1. For illustrative purposes only, DEMUXs 160 coupled to respective ones of first to third output lines O1 to O3 are shown in FIG. 3.

Referring to FIG. 3, each DEMUX 160 includes first to fourth switches SW1 to SW4. The first to fourth switches SW1 to SW4 are respectively coupled between a same output line (O1, O2, or O3) and different data lines D.

In one embodiment, odd-numbered data lines are coupled to pixels 140 positioned on an odd-numbered (or even-numbered) horizontal line. Even-numbered data lines are coupled to pixels 140 positioned on an even-numbered (or odd-numbered) horizontal line. The first and third switches SW1 and SW3 in each DEMUX 160 are coupled to odd-numbered (or even-numbered) data lines. The second and fourth switches SW2 and SW4 in each DEMUX 160 are coupled to even-numbered (or odd-numbered) data lines.

Thus, when the first and third switches SW1 and SW3 are progressively turned on during a specific horizontal period, the data signals are supplied to the odd-numbered data lines. If the second and fourth switches SW2 and SW4 are progressively turned on during the next horizontal period, the data signal is supplied to the even-numbered data lines.

Figure 4:
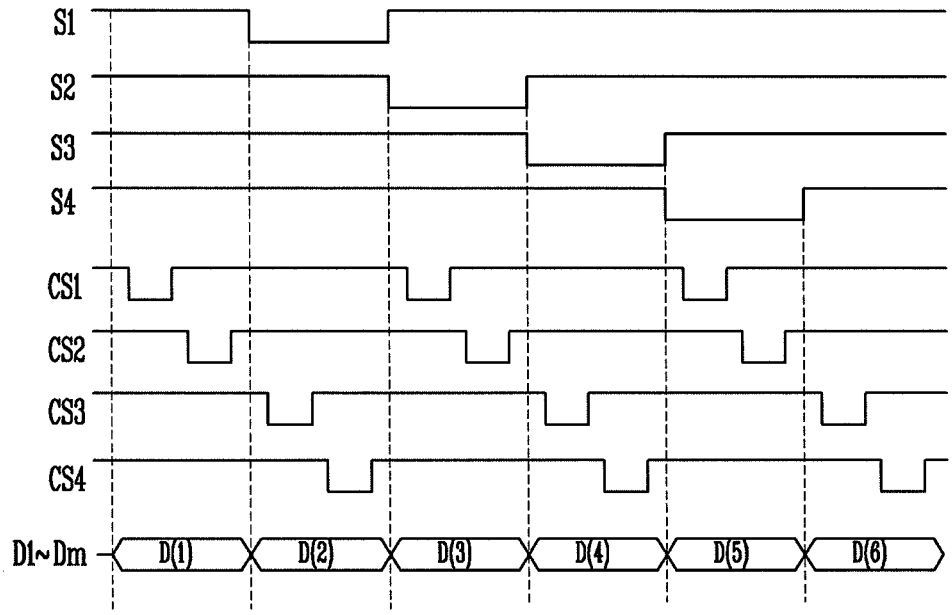
FIG. 4 illustrates an embodiment of a method for operating the demultiplexer.

FIG. 4 illustrates an embodiment of a method for operating the DEMUX 160 in FIG. 3. Referring to FIG. 4, the first and second control signals CS1 and CS2 are progressively supplied from the DEMUX controller 170 before a scan signal is supplied to a first scan line S1. When the first control signal CS1 is supplied, the first switch SW1 is turned on. When the second control signal CS2 is supplied, the third switch SW3 is turned on.

When the first switch SW1 turns on, output lines O1, O2, and O3 are respectively coupled to the data lines D1, D5, and D9. Accordingly, a data signal D(1) corresponding to a first horizontal line is supplied to the data lines D1, D5, and D9. The data signal D(1) supplied to data lines D1, D5, and D9 is charged in a parasitic capacitor of each of the data lines D1, D5, and D9.

When third switch SW3 turns on, the output lines O1, O2, and O3 are respectively coupled to the data lines D3, D7, and D11. Accordingly, the data signal D(1) corresponding to the first horizontal line is supplied to the data lines D3, D7, and D11. The data signal D(1) is charged in a parasitic capacitor of each of the data lines D3, D7, and D11. That is, the data signal D(1) corresponding to the first horizontal line is stored in odd-numbered data lines D1, D3, . . . before the scan signal is supplied to the first scan line S1.

Subsequently, the scan signal is supplied to the first scan line S1, and the third and fourth control signals CS3 and CS4 are progressively applied to overlap the scan signal. When the scan signal is supplied to the first scan line S1, each pixel 140 positioned on the first horizontal line is coupled to one of the odd-numbered data lines D1, D3, . . . . Then, the data signal D(1) stored in the odd-numbered data lines D1, D3, . . . is supplied to the pixels 140.

When the third control signal CS3 is supplied, the second switch SW2 turns on. When second switch SW2 turns on, the output lines O1, O2, and O3 are respectively coupled to data lines D2, D6, and D10, Accordingly, a data signal D(2) corresponding to a second horizontal line is supplied to the data lines D2, D6, and D10. The data signal D(2) supplied to the data lines D2, D6, and D10 is charged in a parasitic capacitor of each of the data lines D2, D6 and D10.

When the fourth control signal CS4 is supplied, the fourth switch SW4 turns on. When fourth switch SW4 turns on, output lines O1, O2, and O3 are respectively coupled to data lines D4, D8, and D12. Accordingly, the data signal D(2) is supplied to the data lines D4, D8 and D12. The data signal D(2) supplied to data lines D4, D8, and D12 is charged in a parasitic capacitor of each of the data lines D4, D8 and D12. That is, the data signal D(2) corresponding to the second horizontal line is stored in the even-numbered data lines D2, D4, . . . during the period in which the scan signal is supplied to the first scan line S1.

Subsequently, a scan signal is supplied to a second scan line S2, and the first and second control signals CS1 and CS2 are progressively applied to overlap the scan signal. When the scan signal is supplied to the second scan line S2, each pixel 140 positioned on the second horizontal line is coupled to one of the even-numbered data lines D2, D4, . . . . Then, the data signal D(2) stored in the even-numbered data lines D2, D4, . . . is supplied to the pixels 140.

When the first and second control signals CS1 and CS2 are progressively supplied, a data signal D(3) corresponding to a third horizontal line is stored in a parasitic capacitor of each of the odd-numbered data lines D1, D3, . . . . In additional operations, data signals are supplied to remaining pixels 140 by repeating the aforementioned process.

As described above, the data signal corresponding to the (j+1)-th horizontal line is supplied during the period in which the scan signal is supplied to the j-th scan line. In this case, the scan signal may overlap the control signal of the DEMUX controller 170. Accordingly, it is possible to secure the supply time of the data signal.

Figure 5:
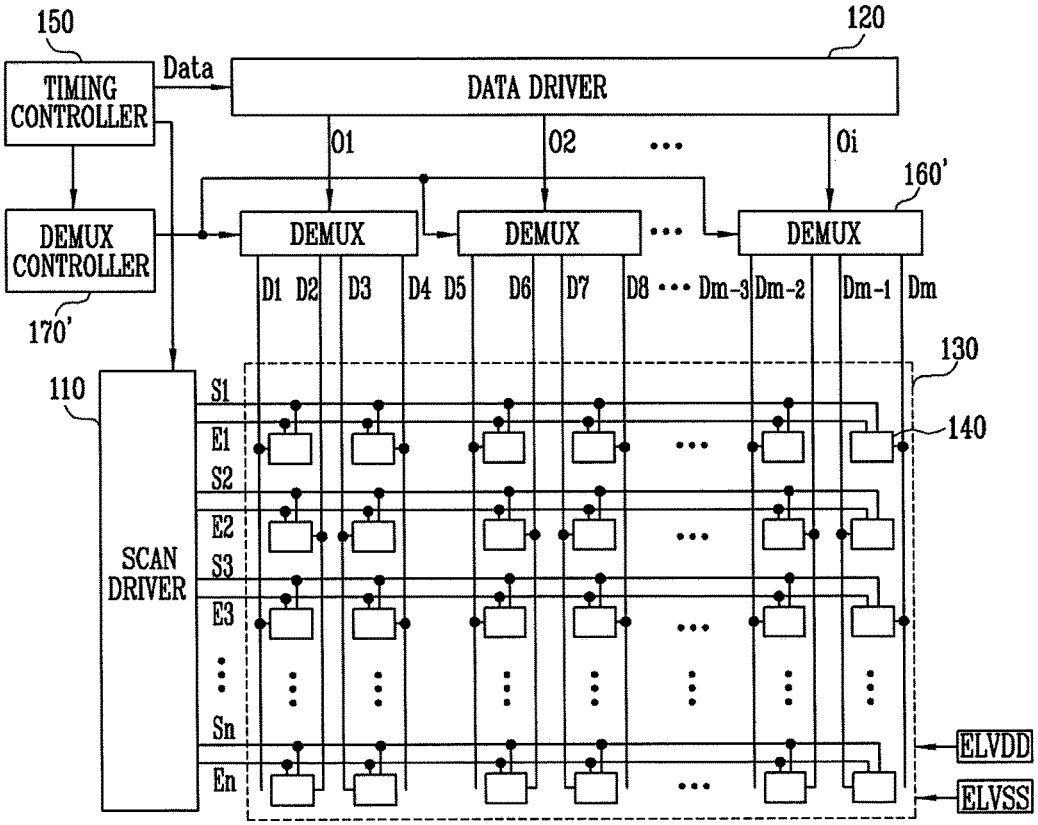
FIG. 5 illustrates another embodiment of an organic light emitting display device.

FIG. 5 illustrates another embodiment of an organic light emitting display device. This embodiment may be the same as FIG. 1, except as noted below.

Referring to FIG. 5, the organic light emitting display device includes the scan driver 110, the data driver 120, the pixel unit 130 including pixels 140, the timing controller 150, DEMUXs 160', and a DEMUX controller 170'. The DEMUXs 160' are respectively coupled to output lines O1 to Oi. A plurality of data lines are coupled to each DEMUX 160'.

Among the data lines coupled to DEMUX 160', odd-numbered data lines are coupled in a zigzag form based on horizontal lines. For example, a first data line D1 coupled to a first DEMUX 160' is coupled to pixels 140 positioned on odd-numbered horizontal lines, and a third data line D3 coupled to the first DEMUX 160' is coupled to pixels 140 positioned on even-numbered horizontal lines.

Similarly, among the data lines coupled to DEMUX 160', even-numbered data lines are coupled in a zigzag form based on the horizontal lines. For example, a second data line D2 coupled to the first DEMUX 160' is coupled to pixels 140 positioned on the even-numbered horizontal lines, and a fourth data line D4 coupled to the first DEMUX 160' is coupled to pixels 140 positioned on the odd-numbered horizontal lines. Adjacent odd- and even-numbered data lines may be alternately coupled to pixels 140 on the same vertical line.

DEMUX controller 170' supplies a plurality of control signals to each DEMUX 160. For example, DEMUX controller 170' may control the supply of control signals so that data signals are supplied for each horizontal line.

Figure 6:
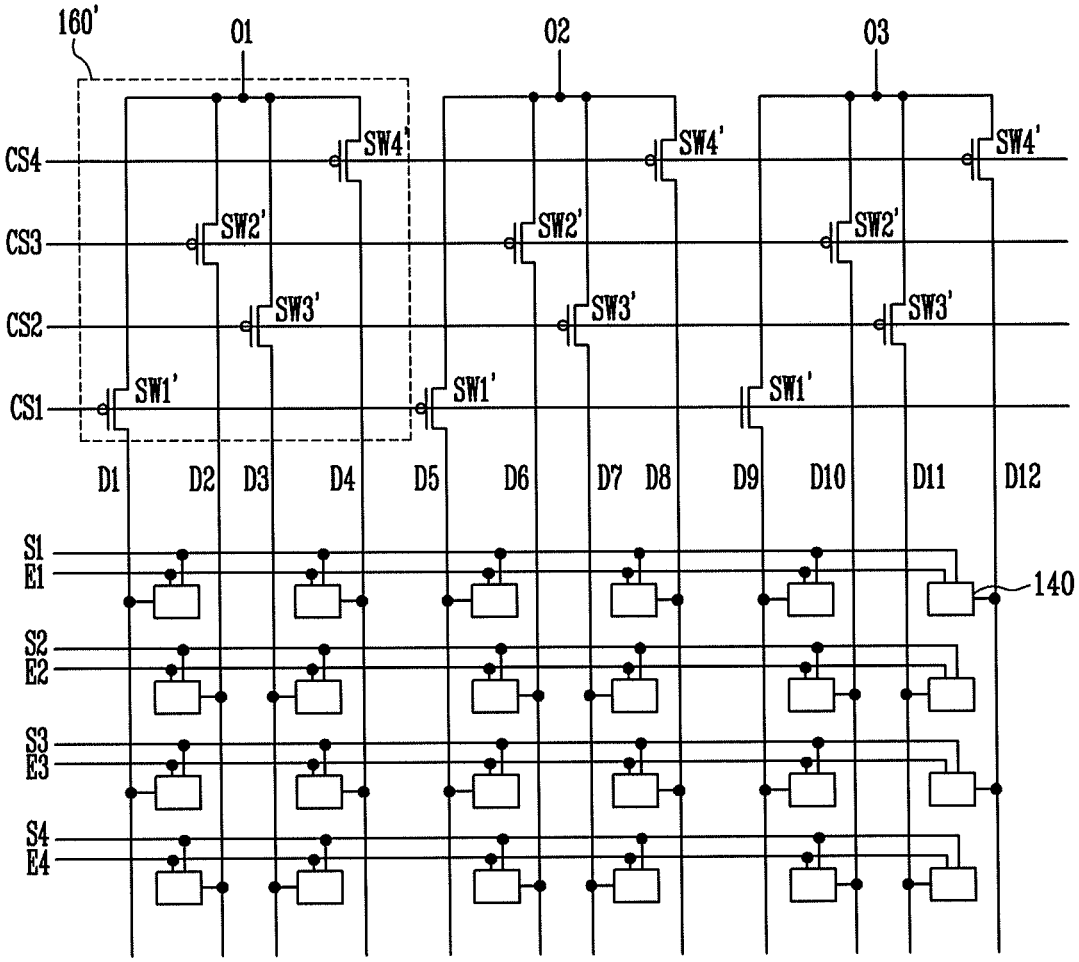
FIG. 6 illustrates another embodiment of a demultiplexer.

FIG. 6 illustrates an embodiment of DEMUX 160' in FIG. 5. For convenience of illustration, a DEMUX coupled to first to third output lines O1 to O3 is shown.

Referring to FIG. 6, each DEMUX 160' includes first to fourth switches SW1' to SW4'. The first to fourth switches SW1' to SW4' are respectively coupled between the same output line O1, O2, or O3 and different data lines D. The first and third switches SW1' and SW3' in each DEMUX 160' are coupled to odd-numbered (or even-numbered) data lines. The second and fourth switches SW2' and SW4' in each DEMUX 160' are coupled to even-numbered (or odd-numbered) data lines.

The first and third switches SW1' and SW3' are turned on during different horizontal periods, so that the data signal can be supplied for each horizontal line. Similarly, the second and fourth switches SW2' and SW4' are turned on during different horizontal periods, so that the data signal can be supplied for each horizontal line.

The first and fourth switches SW1' and SW4' are progressively turned on during the same horizontal period, so that the data signal can be supplied for each horizontal line. Similarly, the second and third switches SW2' and SW3' are progressively turned on during the same horizontal period, so that the data signal can be supplied for each horizontal line.

Figure 7:
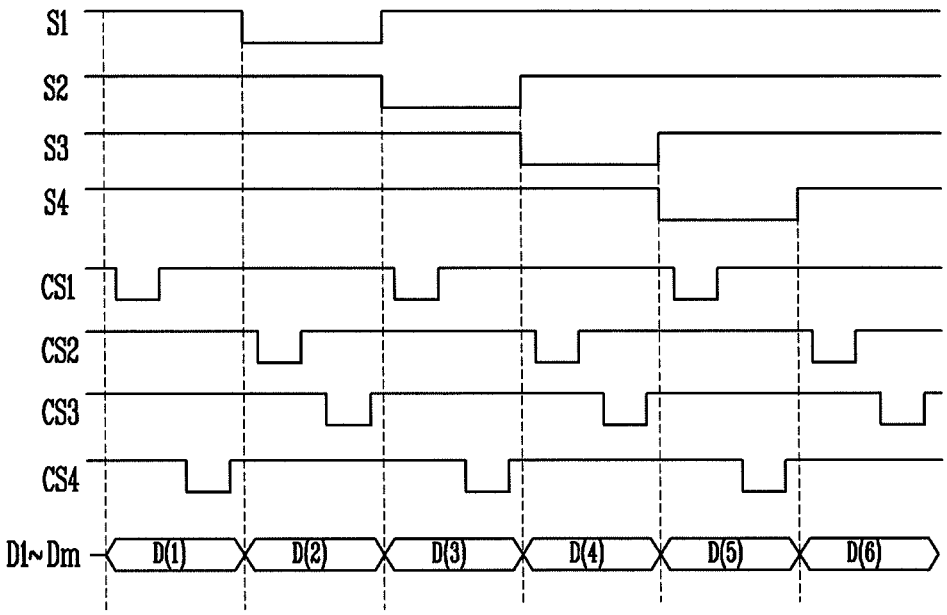
FIG. 7 illustrates another embodiment of operating a deultiplexer.

FIG. 7 illustrates another embodiment of a method for operating the DEMUX in FIG. 6. Referring to FIG. 7, the first and fourth control signals CS1 and CS4 progressively supplied from the DEMUX controller 170' before a scan signal is supplied to the first scan line S1. When the first control signal CS1 is supplied, the first switch SW1' is turned on. When the fourth control signal CS4 is supplied, the fourth switch SW4' is turned on.

When the first switch SW1' is turned on, the output lines O1, O2, and O3 are respectively coupled to the data lines D1, D5, and D9. Accordingly, a data signal D(1) corresponding to a first horizontal line is supplied to data lines D1, D5, and D9. The data signal D(1) is charged in a parasitic capacitor of each of data lines D1, D5 and D9.

When the fourth switch SW4' is turned on, the output lines O1, O2, and O3 are respectively coupled to the data lines D4, D8 and D12. Accordingly, the data signal D(1) corresponding to the first horizontal line is supplied to the data lines D4, D8, and D12. The data signal D(1) is charged in a parasitic capacitor of each of the data lines D4, D8, and D12. That is, before the scan signal is supplied to the first scan line S1, the data signal D(1) corresponding to the horizontal line is stored in the data lines D1, D4, D5, D8, D9, and D12 coupled to pixels 140 positioned on the first horizontal line.

Subsequently, the scan signal is supplied to the first scan line S1, and second and the third control signals CS2 and CS3 are progressively applied to overlap the scan signal. When the scan signal is supplied to the first scan line S1, the pixels 140 positioned on the first horizontal line are selected. In this case, the data signal D(1) stored in the data lines D1, D4, D5, D8, D9, and D12 are supplied to the pixels 140.

When second control signal CS2 is supplied, third switch SW3' is turned on. When third switch SW3' is turned on, output lines O1, O2, and O3 are respectively coupled to data lines D3, D7, and D11. Accordingly, a data signal D(2)

corresponding to a second horizontal line is supplied to the data lines D3, D7, and D11. The data signal D(2) is charged in a parasitic capacitor of each of the data lines D3, D7 and D11.

When the third control signal CS3 is supplied, second switch SW2' is turned on. When the second switch SW2' is turned on, the output lines O1, O2, and O3 are respectively coupled to data lines D2, D6, and D10. Accordingly, the data signal D(2) corresponding to the second horizontal line is supplied to the data lines D2, D6, and D10. The data signal D(2) is charged in a parasitic capacitor of each of the data lines D2, D6 and D10. That is, during the period in which the scan signal is supplied to the first scan line S1, the data signal D(2) corresponding to the second horizontal line is stored in the data lines D2, D3, D6, D7, D10, and D11 coupled to the pixels 140 on the second horizontal line.

Subsequently, a scan signal is supplied to the second scan line S2, and the first and fourth control signals CS1 and CS4 are progressively applied to overlap the scan signal. When the scan signal is supplied to the second scan line S2, the pixels 140 positioned on the second horizontal line are selected. In this case, the data signal D(2) stored in the data lines D2, D3, D6, D7, D10, and D11 is supplied to the pixels 140. When the first and fourth control signals CS1 and CS4 are progressively supplied, a data signal D(3) corresponding to a third horizontal line is stored in the data lines D1, D4, D5, D8, D9, and D12. In additional operations, data signals are supplied to remaining pixels 140 by repeating the aforementioned process.

Additionally, in this embodiment, the odd-numbered data lines are coupled in a zigzag form based on the horizontal lines. Similarly, the even-numbered data lines are also coupled in a zigzag form based on the horizontal lines. By coupling the odd-numbered data lines and even-numbered data lines in respective zigzag forms, it is possible to prevent the occurrence of lateral line noise.

In the present embodiment, the order in which the control signals are supplied during horizontal periods may be variously set. For example, the first and fourth control signals CS1 and CS4 may be progressively supplied during a specific horizontal period, and the third and second control signals CS3 and CS2 may be progressively supplied during the next horizontal period.

The aforementioned embodiments include PMOS transistors. In other embodiments, NMOS transistors may be used. Also, each OLED may generate red, green, or blue light based on the amounts of current supplied from corresponding driving transistors. In other embodiments, white light may be emitted based on the amount of the current supplied from the driving transistor. In this latter case, a color image may be implemented using separate color filters.

By way of summation and review, in accordance with one or more of the aforementioned embodiments, data lines coupled to a current horizontal line are physically separated from those coupled to a next horizontal line. In this case, a data signal can be supplied to the data lines corresponding to the next horizontal line during a period in which a scan signal is supplied to the current horizontal line while still displaying a desired image and compensating the threshold voltage of the driving transistor. Without such a separation, a data signal of a previous period, rather than a scan signal of the previous horizontal line, may be supplied, dividing the horizontal period to avoid this during the display period. Accordingly, embodiments herein improve display quality.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light emitting display device, comprising:

a plurality of pixels in an area defined by scan lines and data lines;

a data driver to progressively supply a plurality of data signals to output lines every horizontal period; and a plurality of demultiplexers (DEMUXs) coupled to respective ones of the output lines, each DEMUX to supply data signals to a number of first data lines coupled to the DEMUX during a first horizontal period and to supply one or more data signals to a number of second data lines coupled to the DEMUX during a second horizontal period, at least one of the second data lines between adjacent ones of the first data lines, wherein one of the first data lines and one of the second data lines are between pixels on a n-th vertical line and pixels on a (n+1)-th vertical line, and are coupled to pixels on a same horizontal line.

2. The display device as claimed in claim 1, wherein the number of data lines is coupled to pixels on a same horizontal line.

3. The display device as claimed in claim 1, wherein each DEMUX is coupled two or more odd-numbered and two or more even-numbered data lines.

4. The display device as claimed in claim 3, wherein:

the odd-numbered data lines are coupled to pixels on an 1-th horizontal line, and the even-numbered data lines are coupled to pixels on an (1+1)-th horizontal line.

5. The display device as claimed in claim 4, wherein adjacent odd-numbered and even-numbered data lines are alternately coupled to pixels on a same vertical line.

6. The display device as claimed in claim 3, wherein:

the odd-numbered data lines are coupled in a zigzag form to pixels on different horizontal lines, and the even-numbered data lines are coupled in a zigzag form to pixels on different horizontal lines.

7. The display device as claimed in claim 6, wherein adjacent odd-numbered and even-numbered data lines are alternately coupled to pixels on a same vertical line.

8. The display device as claimed in claim 1, further comprising:

a scan driver to supply a scan signal to the scan lines; and a DEMUX controller to supply, to each DEMUX, control signals to overlap data signals progressively supplied from the data driver.

9. The display device as claimed in claim 8, wherein the DEMUX controller is to output the control signals, so that data signals corresponding to a (j+1)-th horizontal line are supplied when a scan signal is supplied to a scan line on a j-th horizontal line.

10. The display device as claimed in claim 9, wherein the DEMUX controller is to output the control signals, so that the data signal corresponding to a first horizontal line is supplied before a scan signal is supplied to a first scan line.

11. An organic light emitting display device, comprising:

a plurality of pixels in an area defined by scan lines and data lines;

a data driver to progressively supply a plurality of data signals to output lines every horizontal period;

a plurality of DEMUXs coupled to respective ones of the output lines; and a DEMUX controller to control each DEMUX to supply data signals to first data lines coupled to each DEMUX during a first horizontal period, and to supply data signals to second data lines coupled to each DEMUX during a second horizontal period, wherein the first data lines are respectively coupled to pixels on an 1-th horizontal line, wherein the second data lines are respectively coupled to pixels on an (1+1)-th horizontal line, wherein at least one of the second data lines is between adjacent ones of the first data lines, and wherein one of first data lines and one of the second data lines are between pixels on a n-th vertical line and pixels on a (n+1)-th vertical line, and are coupled to pixels on a same horizontal line.

12. The display device as claimed in claim 11, wherein the data signal is supplied to the second data lines, via said each DEMUX, during a period in which a scan signal is supplied to pixels coupled to the first data lines.

13. The display device as claimed in claim 11, wherein:

the first data lines are odd-numbered data lines, and the second data lines are even-numbered data lines.

14. The display device as claimed in claim 13, wherein adjacent odd-numbered and even-numbered data lines are alternately coupled to pixels on a same vertical line.

15. The display device as claimed in claim 11, wherein:

the first data lines include odd-numbered data lines and even-numbered data lines, and the second data lines include odd-numbered data lines and even-numbered data lines, which are not included in the first data lines.

16. The display device as claimed in claim 15, wherein adjacent odd-numbered and even-numbered data lines are alternately coupled to pixels on a same vertical line.

17. A method of driving an organic light emitting display device, the method comprising:

supplying a data signal to first data lines coupled to a DEMUX during a first horizontal period; and supplying a data signal to second data lines coupled to the DEMUX during a second horizontal period, wherein the first data lines are respectively coupled to pixels on an 1-th horizontal line, wherein the second data lines are respectively coupled to pixels on an (1+1)-th horizontal line, wherein at least one of the second data lines is between adjacent ones of the first data lines, and wherein one of first data lines and one of the second data lines are between pixels on a n-th vertical line and pixels on a (n+1)-th vertical line, and are coupled to pixels on a same horizontal line.

18. The method as claimed in claim 17, wherein the data signal is supplied to the second data lines via the DEMUX during a period in which a scan signal is supplied to pixels coupled to the first data lines.

19. The method as claimed in claim 17, wherein:

the first data lines are odd-numbered data lines, and the second data lines are even-numbered data lines.

20. The method as claimed in claim 17, wherein:

the first data lines include odd-numbered data lines and even-numbered data lines, and the second data lines include odd-numbered data lines and even-numbered data lines, which are not included in the first data lines.

* * * * *